US011291096B2

(12) United States Patent
Lu et al.

(10) Patent No.: US 11,291,096 B2
(45) Date of Patent: Mar. 29, 2022

(54) DIMMABLE LIGHT TUBE WITH ANTI-ELECTRIC SHOCK PROTECTION FUNCTION

(71) Applicant: Xiamen PVTECH Co., Ltd., Fujian (CN)

(72) Inventors: Fuxing Lu, Fujian (CN); Rongtu Liu, Fujian (CN)

(73) Assignee: Xiamen PVTECH Co., Ltd., Xiamen (CN)

( * ) Notice: Subject to any disclaimer, the term of this patent is extended or adjusted under 35 U.S.C. 154(b) by 0 days.

(21) Appl. No.: 16/997,949

(22) Filed: Aug. 20, 2020

(65) Prior Publication Data

US 2021/0378071 A1 Dec. 2, 2021

(30) Foreign Application Priority Data

May 29, 2020 (CN) ..... 202010478964.2

(51) Int. Cl.
*H05B 45/50* (2022.01)
*F21K 9/278* (2016.01)
(Continued)

(52) U.S. Cl.
CPC ..... *H05B 45/50* (2020.01); *F21K 9/278* (2016.08); *H05B 45/10* (2020.01); *H05B 47/19* (2020.01); *F21Y 2115/10* (2016.08)

(58) Field of Classification Search
CPC ..... H01J 65/048; H01J 61/56; H01J 61/28; H01J 5/54; H01J 7/20; H01J 7/22; H01J 9/247; H01J 9/323; H01J 9/34; H01J 9/395; H01J 9/40; H01J 61/523; H01J 61/20; H01J 61/24; H01J 61/35; H01J 61/44; H01J 61/46; H01J 61/72; H01J 65/042; H01J 1/52; H01J 61/545; H01J 61/547; H05B 41/2806; H05B 45/3725; H05B 41/3921; H05B 45/38; H05B 45/50; H05B 41/38; H05B 45/375; H05B 45/3578; H05B 45/20; H05B 45/325; H05B 45/37; H05B 41/3927; H05B 45/355; H05B 45/385; H05B 41/3924; H05B 45/22;
(Continued)

(56) References Cited

U.S. PATENT DOCUMENTS 10,959,301 B1 * 3/2021 Lu ..... H05B 45/14
2017/0358441 A1 * 12/2017 Nanchung ..... H01J 9/34
(Continued)

*Primary Examiner* — Monica C King
(74) *Attorney, Agent, or Firm* — Winston Hsu

(57) ABSTRACT

A dimmable light tube with anti-electric shock protection function includes two conductive pin assemblies, a bridge rectifier, an anti-electric shock detection control circuit, and a buck-boost constant current module. The bridge rectifier is connected to the conductive pin assemblies. The anti-electric shock detection control circuit is connected to the bridge rectifier, and the anti-electric shock detection control circuit has an output end and a resistor. The input end of the buck-boost constant current module is connected to the output end and the driving module is connected to the resistor so as to perform the leakage control function. The current conduction angle of the current generated by the transmission of the anti-electric shock detection control circuit can be changed by the buck-boost constant current module, so that the dimming function can be provided.

4 Claims, 6 Drawing Sheets

(51) Int. Cl.
*H05B 47/19* (2020.01)
*H05B 45/10* (2020.01)
*F21Y 115/10* (2016.01)

(58) Field of Classification Search
CPC ..... H05B 45/395; H05B 45/40; H05B 45/56; H05B 45/44; H05B 41/16; H05B 41/24; H05B 41/2821; H05B 41/382; H05B 45/10; H05B 45/24; H05B 45/3574; H05B 45/382; H05B 45/46; H05B 45/48; H05B 41/3925; H05B 45/00; H05B 45/357; H05B 45/3575; H05B 45/36; H05B 45/60; H05B 47/105; H05B 47/11; H05B 47/16; H05B 47/175; H05B 47/18; H05B 47/185; H05B 47/19; H05B 47/195
See application file for complete search history.

(56) References Cited

U.S. PATENT DOCUMENTS

2017/0370534 A1* 12/2017 Xiong ..... F21V 23/006
2019/0394849 A1* 12/2019 Wang ..... H05B 45/382

* cited by examiner

DIMMABLE LIGHT TUBE WITH ANTI-ELECTRIC SHOCK PROTECTION FUNCTION

Cross Reference To Related Application

This application claims priority of China Application No. 202010478964.2 filed on May 29, 2020.

BACKGROUND OF THE INVENTION

1. Field of the Invention

The present invention relates to a dimmable light tube, in particular to a dimmable light tube with anti-electric shock protection function.

2. Description of the Prior Art

For existing LED light tubes, the turn-on or the turn-off can be controlled by the switch. Nevertheless, along with the technology advancements, the product access threshold of the LED light tubes upgrades continuously. As a result, since the existing LED light tubes are devoid of the dimming function and the anti-electric shock protection function, the existing LED light tubes are obsolete for entering into the nowadays product access threshold regarding the ease of use issue and the safety issue.

Therefore, how to address the issues is to be considered.

SUMMARY OF THE INVENTION

In view of these, in one embodiment, a dimmable light tube with anti-electric shock protection function is provided. The dimmable light tube comprises two conductive pin assemblies, abridge rectifier, an anti-electric shock detection control circuit, and a buck-boost constant current module. The two conductive pin assemblies are disposed at two ends of the dimmable light tube and are electrically connected to a mains supply. The bridge rectifier is connected to the conductive pin assemblies. The anti-electric shock detection control circuit is connected to the bridge rectifier and has an output end. The anti-electric shock detection control circuit has a resistor. The buck-boost constant current module comprises a driving module connected to the resistor to perform a leakage control function. The buck-boost constant current module detects a rectified current conduction angle so as to perform a dimming function according to different current conduction angles.

In one or some preferable implementations of the dimmable light tube with anti-electric shock protection function, the dimmable light tube further comprises a wireless controller. The wireless controller comprises a wireless dimmable module and a module power-supply circuit. The wireless dimmable module is connected to the buck-boost constant current module. The module power-supply circuit is connected to the wireless dimmable module, and the wireless dimmable module is wirelessly connected to an external dimming control apparatus.

In one or some preferable implementations of the dimmable light tube with anti-electric shock protection function, the external dimming control apparatus is an application program for a mobile device or another wireless controller.

In one or some preferable implementations of the dimmable light tube with anti-electric shock protection function, the dimmable light tube further comprises a ballast electrically connected to the anti-electric shock detection control circuit. The ballast provides the dimmable light tube to have a wireless dimming function functioned normally.

In one or some preferable implementations of the dimmable light tube with anti-electric shock protection function, the dimmable light tube further comprises dimming control circuit module. The dimming control circuit module comprises a mains-supply switch detection circuit unit, a micro-control unit, and a power-supply unit. The mains-supply switch detection circuit unit is connected to the anti-electric shock detection control circuit, and the power-supply unit is electrically connected to the micro-control unit for current supply.

Based on the above, the dimmable light tube according to one or some embodiments has following advantages. The input end of the buck-boost constant current module is connected to the output end and the driving module is connected to the resistor so as to perform the leakage control function. Moreover, the current conduction angle of the current generated by the transmission of the anti-electric shock detection control circuit can be changed by the buck-boost constant current module, so that the dimming function can be provided.

These and other objectives of the present invention will no doubt become obvious to those of ordinary skill in the art after reading the following detailed description of the preferred embodiment that is illustrated in the various figures and drawings.

DETAILED DESCRIPTION

The detailed description of the technical content, structural features, and the objects and effects of the technical solutions will be described in detail below with reference to the specific embodiments and the accompanying drawings.

Figure 1:
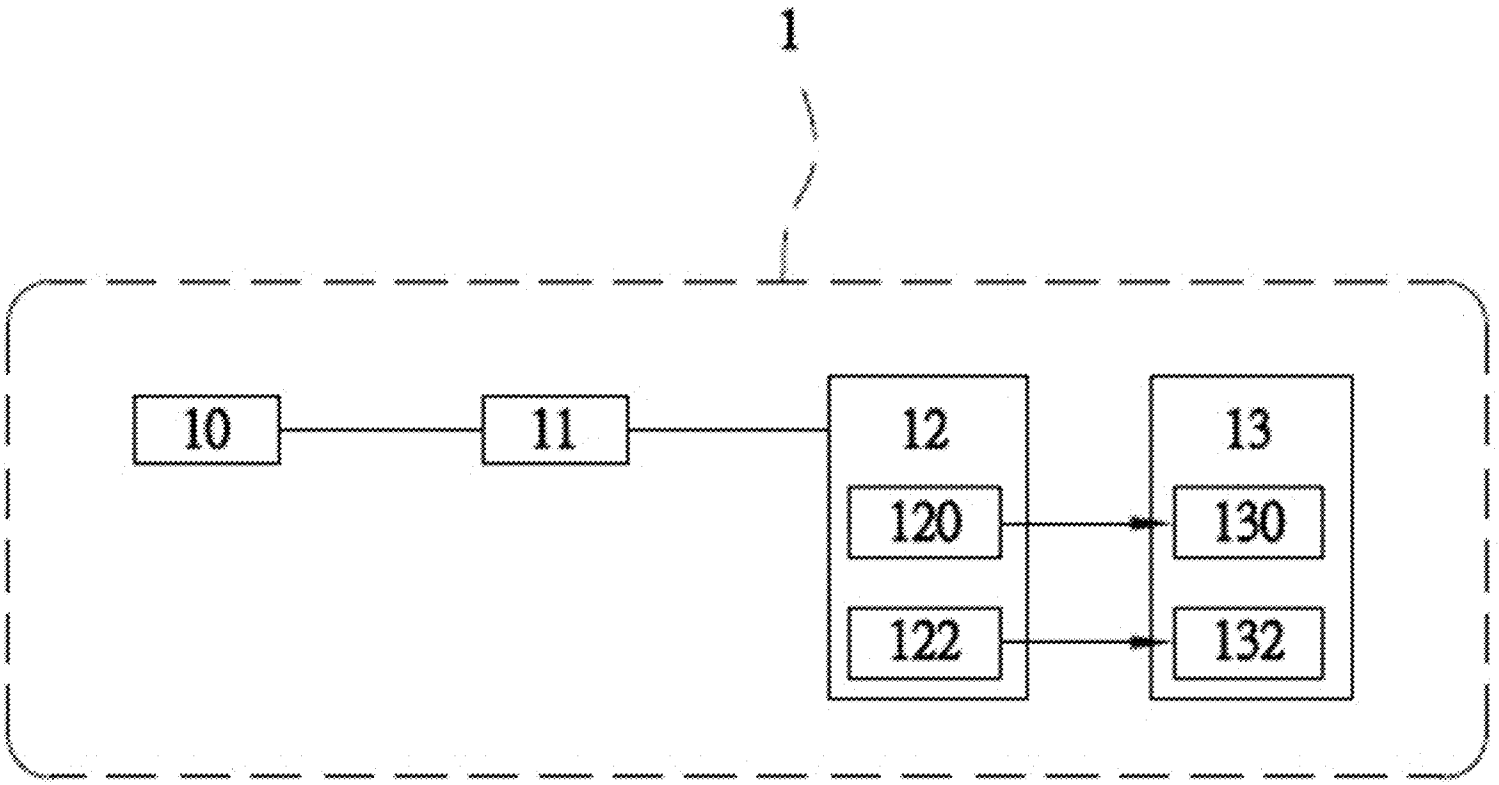
FIG. 1 illustrates a schematic block diagram of a dimmable light tube with anti-electric shock protection function according to an exemplary embodiment of the present invention.
Figure 2:
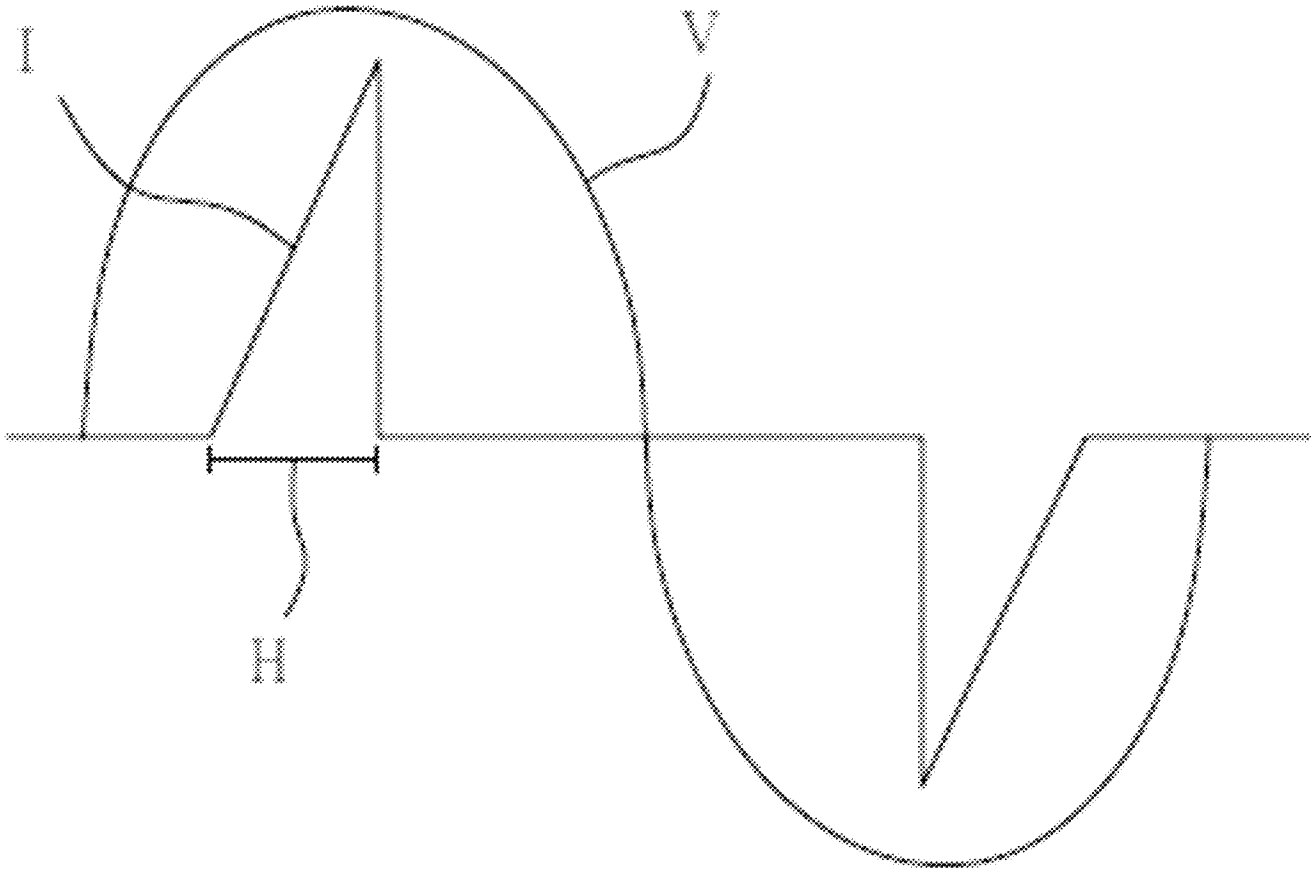
FIG. 2 illustrates a schematic view of a first waveform of the current conduction angle.
Figure 3:
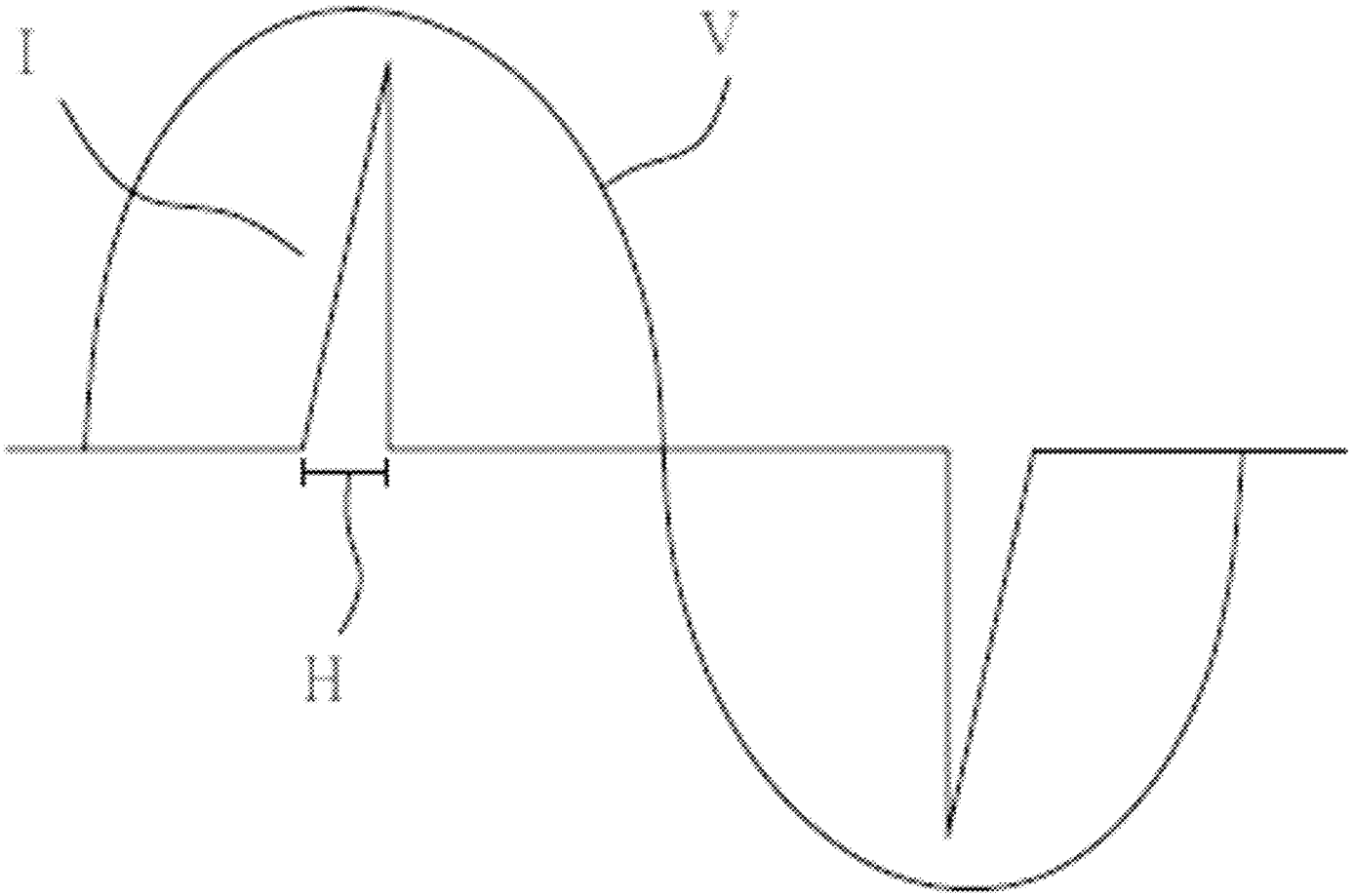
FIG. 3 illustrates a schematic view of a second waveform of the current conduction angle.

Please refer to FIGS. 1, 2, and 3, respectively a schematic block diagram of a dimmable light tube with anti-electric shock protection function, a schematic view of a first waveform, and a schematic view of a second waveform, according to an exemplary embodiment of the present invention. A dimmable light tube with anti-electric shock protection function is provided, and the dimmable light tube 1 comprises two conductive pin assemblies 10, a bridge rectifier 11, an anti-electric shock detection control circuit 12, and a buck-boost constant current module 13. The two conductive pin assemblies 10 are disposed at two ends of the dimmable light tube 1 and are electrically connected to a mains supply. The bridge rectifier 11 is connected to the conductive pin assemblies 10. The anti-electric shock detection control circuit 12 is connected to the bridge rectifier 11 and has an output end 120. The anti-electric shock detection control circuit 12 has a resistor 122. The buck-boost constant current module 13 has an input end 130 connected to the output end 120, and the buck-boost constant current module 13 comprises a driving module 132 (in this embodiment, a driving IC) connected to the resistor 122 to perform the leakage control function. The current I rectified by the bridge rectifier 11 passes through the anti-electric shock detection control circuit 12 and finally passes through the buck-boost constant current module 13. The buck-boost constant current module 13 performs the dimming function according to the rectified current conduction angle H. As shown in FIGS. 2 and 3, in the case that the voltage is fixed, when the conduction angle H of the current I is different, the luminance of the dimmable light tube 1 is different; when the waveform conduction angle H of the current I is larger, the luminance of the dimmable light tube 1 is higher (as shown in FIG. 2) , while when the waveform conduction angle H of the current I is smaller, the luminance of the dimmable light tube 1 is lower (as shown in FIG. 3).

Figure 4:
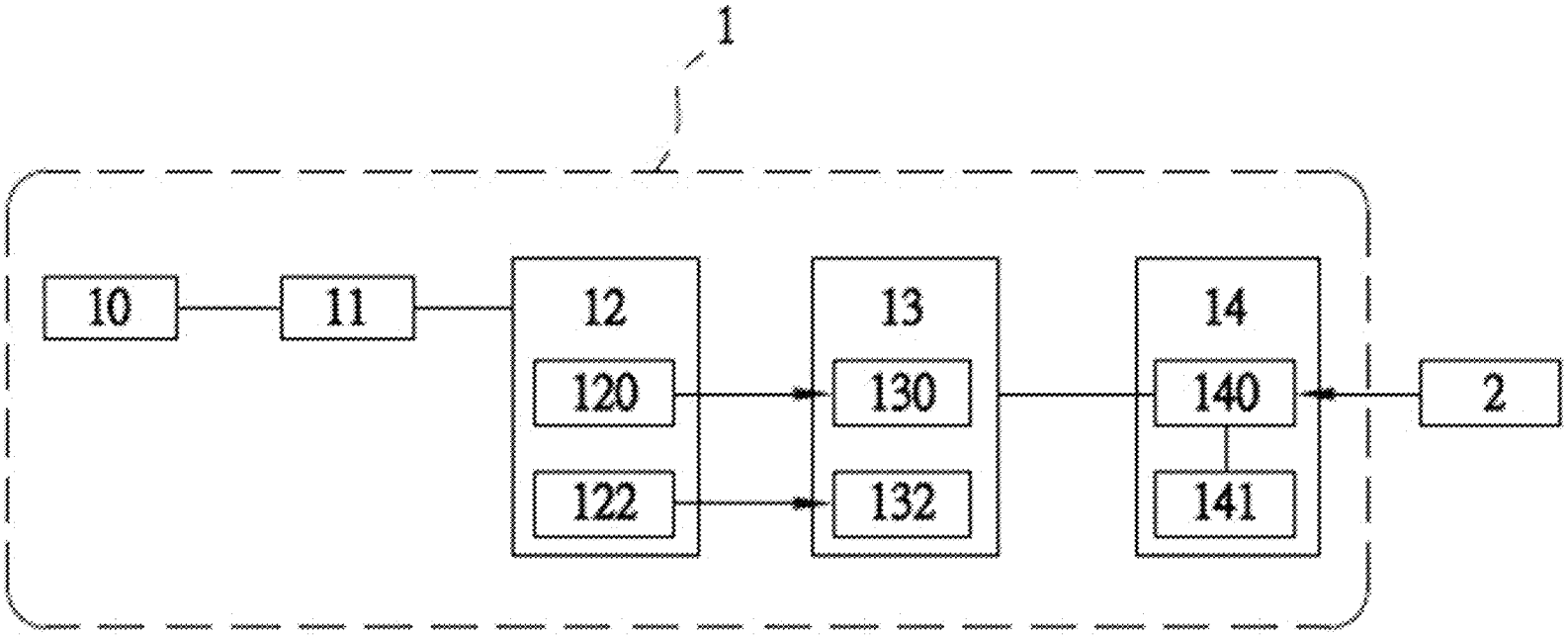
FIG. 4 illustrates a schematic block diagram of the dimmable light tube of the exemplary embodiment combined with a wireless controller.

Please further refer to FIG. 4. FIG. 4 illustrates a schematic block diagram of the dimmable light tube of the exemplary embodiment combined with a wireless controller. The dimmable light tube 1 as mentioned above may further comprise a wireless controller 14. The wireless controller 14 comprises a wireless dimming module 140 and a module power-supply circuit 141. The wireless dimming module 140 is connected to an external dimming control apparatus 2 in a wireless manner. The wireless dimming module 140 is connected to the buck-boost constant current module 13. The module power-supply circuit 141 is connected to the wireless dimming module 140 for current supply. The wireless dimming module 140 is wirelessly connected to the external dimming control apparatus 2 (which may be an application program for a mobile device or a wireless controller). The dimming control of the dimmable light tube 1 can be implemented by the external dimming control apparatus 2 through wirelessly connecting the external dimming control apparatus 2 to the wireless dimming module 140. Moreover, the external dimming control apparatus 2 may send a current adjustment signal, and the current I can be changed by the buck-boost constant current module 13 so as to achieve the adjustment of the conduction angle H for performing the luminance dimming function.

Figure 5:
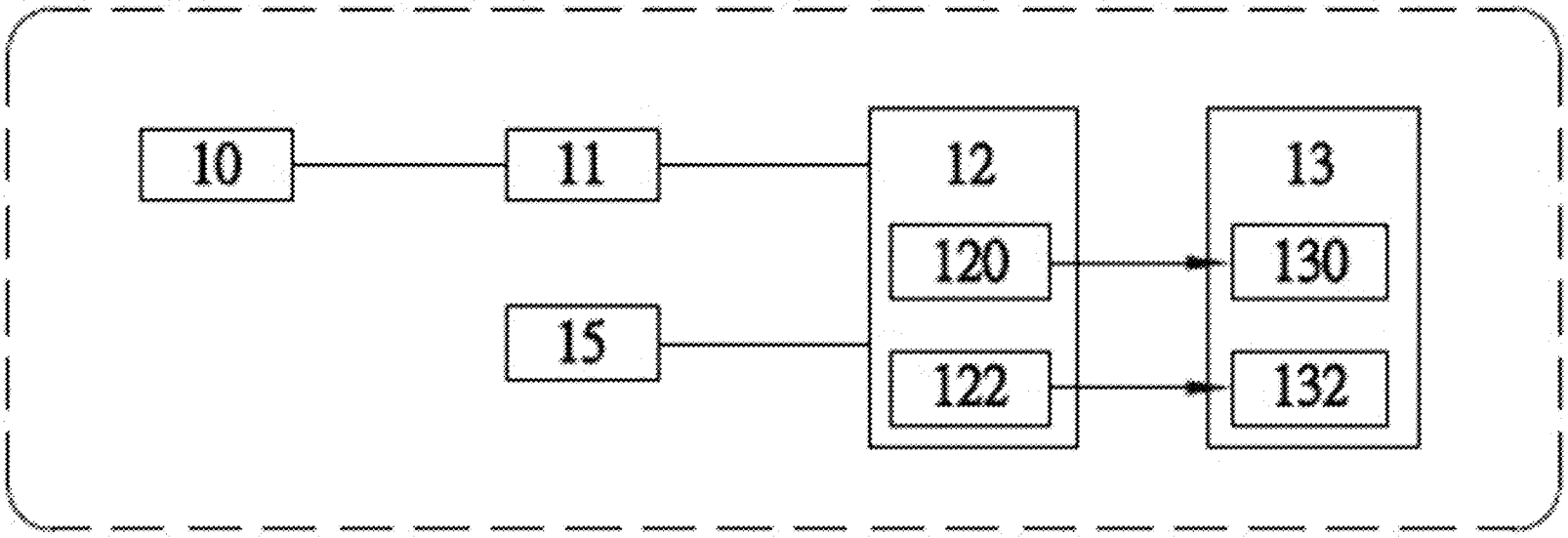
FIG. 5 illustrates a schematic block diagram showing that the dimmable light tube of the exemplary embodiment compatible with a ballast.

Please further refer to FIG. 5. FIG. 5 illustrates a schematic block diagram showing that the dimmable light tube 1 of the exemplary embodiment compatible with a ballast. The dimmable light tube 1 as mentioned above may further comprise a ballast 15. The ballast 15 is electrically connected to the anti-electric shock detection control circuit 12, and the ballast 15 provides the dimmable light tube 1 to have a wireless dimming function functioned normally. In other words, in a normal power-supply condition, the ballast 15 can maintain the wireless dimming function of the wireless controller 14.

Figure 6:
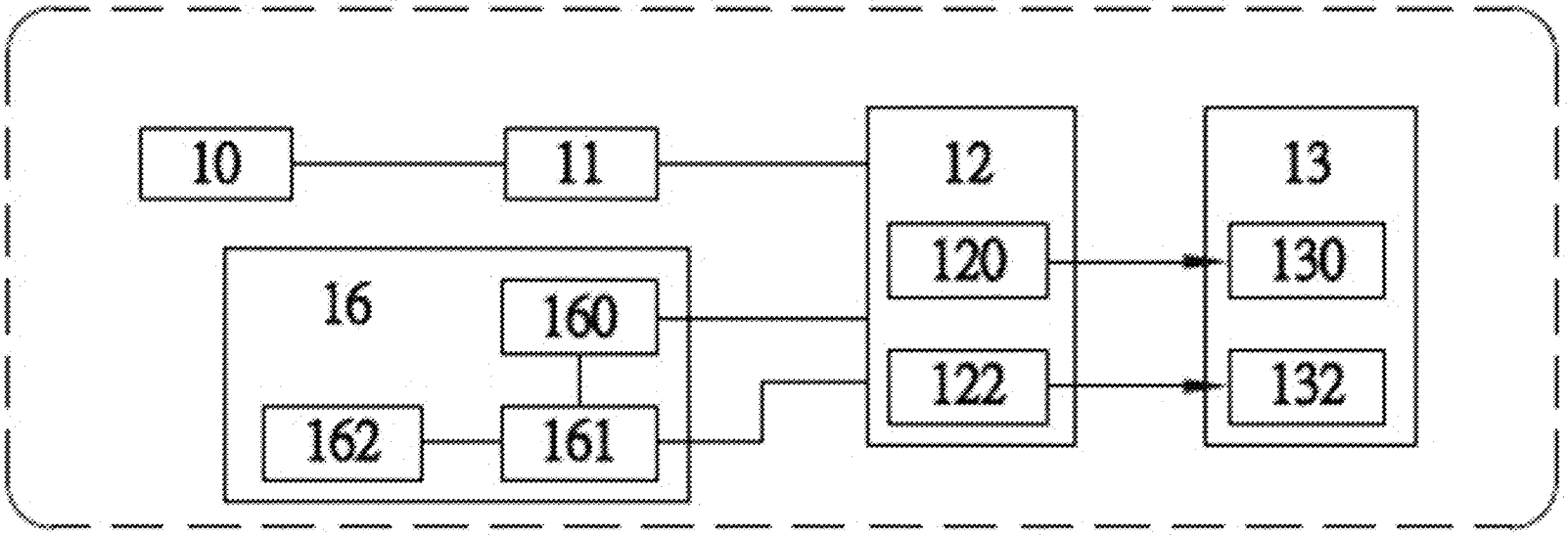
FIG. 6 illustrates a schematic block diagram showing that the dimmable light tube of the exemplary embodiment is controlled by a mains supply.

Please further refer to FIG. 6. FIG. 6 illustrates a schematic block diagram showing that the dimmable light tube of the exemplary embodiment is controlled by a mains supply. The dimmable light tube 1 as mentioned above may further comprise a dimming control circuit module 16. The dimming control circuit module 16 comprises a mains-supply switch detection circuit unit 160, a micro-control unit 161, and a power-supply unit 162. The power-supply unit 162 is electrically connected to the micro-control until 161 for current supply. The mains-supply switch detection circuit unit 160 is connected to the anti-electric shock detection control circuit 12. The mains-supply switch detection circuit unit 160 is operated manually. Hence, after the anti-leakage detection of the anti-electric shock detection control circuit 12 is performed, the switch logics corresponding to the luminance and the states of the light can be edited by the micro-control unit 161 according to actual needs.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A dimmable light tube with anti-electric shock protection function, comprising:

two conductive pin assemblies disposed at two ends of the dimmable light tube and electrically connected to a mains supply;

a bridge rectifier connected to the conductive pin assemblies;

an anti-electric shock detection control circuit connected to the bridge rectifier and having an output end, wherein the anti-electric shock detection control circuit has a resistor;

a buck-boost constant current module having an input end and a driving module, wherein the input end is connected to the output end in series and the driving module is connected to the resistor in series, whereby buck-boost constant current module performs a leakage control function; and a wireless controller comprising a wireless dimmable module and a module power-supply circuit, wherein the wireless dimmable module is connected to the buck-boost constant current module, the module power-supply circuit is connected to the wireless dimmable module, and the wireless dimmable module is wirelessly connected to an external dimming control apparatus;

wherein the external dimming control apparatus sends a current adjustment signal to the wireless dimmable module and the buck-boost constant current module detects a rectified current conduction angle, wherein the buck-boost constant current module changes the rectified current conduction angle according to the current adjustment signal and performs a dimming function according to the rectified current conduction angle changed by the current adjustment signal, wherein the rectified current conduction angle is corresponding to a waveform conduction angle of an input current.

2. The dimmable light tube according to claim 1, wherein the external dimming control apparatus is an application program for a mobile device or another wireless controller.

3. The dimmable light tube according to claim 1, further comprising a ballast electrically connected to the anti-electric shock detection control circuit, wherein the ballast provides the dimmable light tube to have a wireless dimming function functioned normally.

4. The dimmable light tube according to claim 1, further comprising a dimming control circuit module, wherein the dimming control circuit module comprises a mains-supply switch detection circuit unit, a micro-control unit, and a power-supply unit, the mains-supply switch detection circuit unit is connected to the anti-electric shock detection control circuit, the micro-control unit is connected to the mains-supply switch detection circuit unit to control the anti-electric shock detection control circuit, and the power-supply unit is electrically connected to the micro-control unit for current supply.

* * * * *